United States Patent [19]

Nishikawa

[11] Patent Number: 4,984,029

[45] Date of Patent: Jan. 8, 1991

[54] ROLLED RECORDING PAPER SETTING APPARATUS

[75] Inventor: Masaji Nishikawa, Tokyo, Japan

[73] Assignee: Olympus Optical Co., Ltd., Tokyo, Japan

[21] Appl. No.: 416,114

[22] Filed: Oct. 2, 1989

[30] Foreign Application Priority Data

Oct. 7, 1988 [JP] Japan ..... 63-253040

[51] Int. Cl.[5] ..... G03G 21/00

[52] U.S. Cl. ..... 355/310; 355/317

[58] Field of Search ..... 355/310, 326, 327, 400, 355/401, 317; 346/157; 226/12, 28; 358/400, 401

[56] References Cited

U.S. PATENT DOCUMENTS

| | | | |
|---|---|---|---|
| 3,668,876 | 6/1972 | Koehler | 405/327 |
| 4,569,584 | 2/1986 | St. John | 355/244 |
| 4,646,162 | 2/1987 | Sue | 355/310 X |
| 4,686,541 | 8/1987 | Rosier | 355/310 X |
| 4,721,969 | 1/1988 | Asano | 346/157 |
| 4,733,270 | 3/1988 | Nishikawa et al. | 355/324 |
| 4,786,353 | 11/1988 | Templeton et al. | 226/28 X |
| 4,819,024 | 4/1989 | Kagayama et al. | 355/310 |

*Primary Examiner*—Fred L. Braun
*Assistant Examiner*—Sandra L. Hoffman
*Attorney, Agent, or Firm*—Frishauf, Holtz, Goodman & Woodward

[57] ABSTRACT

An apparatus of the invention includes a reciprocating means for reciprocating a predetermined amount of recording paper in the feed and rewinding directions of the recording paper, and is designed such that at least when rolled recording paper is newly set at a predetermined position, a reciprocal operation of the recording paper by the reciprocating means is performed a plurality of times prior to image recording. In this apparatus, when a color image is to be recorded, color misregistration due to a ramp of the recording paper can be prevented. If a means for generating a ramp correction end signal and a means for cutting a recording paper leading end upon completion of ramp correction are added, a further useful apparatus can be realized.

3 Claims, 9 Drawing Sheets

ROLLED RECORDING PAPER SETTING APPARATUS

BACKGROUND OF THE INVENTION

1. Field of the Invention

The present invention relates to a rolled recording paper setting apparatus which can be suitably applied to an image recording apparatus such as an electrostatic color plotter.

2. Description of the Related Art

An image recording apparatus such as a color plotter generally has the following arrangement. An apparatus of this type comprises a recording paper roll, an image recording processing station, a recording paper feed roller, a recording paper take-up roller, and the like. In this arrangement, an extracted portion of rolled recording paper stretched between the recording paper roll and the recording paper take-up roller is reciprocated a plurality of times. During this reciprocation period, a plurality of images of different colors are overlapped on the same image area of the recording paper by means of the image recording processing station, thus obtaining a multicolor image. An apparatus having such an arrangement is disclosed in, e.g., U.S. Pat. No. 4,569,584.

FIG. 1 is a view showing a prior apparatus having the above-described arrangement, which is disclosed in Published Unexamined Japanese Patent Application No. 62-269851 (corresponding U.S. Pat. No. 4,733,270) associated with the prior invention of the present inventor. Referring to FIG. 1, reference numeral 1 denotes a recording paper roll; and 2, an image recording processing station consisting of constituent elements 3 to 8. The constituent element 3 is a multistylus electrostatic recording head; the constituent element 4, a back-surface roller; and the constituent elements 5 to 8, color developing heads of different colors. Reference numeral 10 denotes a recording paper feed roller; 9 and 11, press rollers which are opposed to the roller 10 so as to be in contact therewith; 12, a temporary recording paper take-up unit constituted by a recording paper take-up roller 13, a guide plate 14, a pinch roller 15, a pinch roller guide 16, and the like; 17, a recording paper path switching guide plate having one end pivotally supported by a support shaft 18; and 19, an automatic cutter including a Y cutter 20 for cutting extracted recording paper P in a direction perpendicular to its feed direction, and an X cutter 21 for cutting the recording paper P in a direction parallel to the feed direction.

According to the apparatus shown in FIG. 1, an extracted portion of the rolled recording paper P is reciprocated a plurality of times. During this reciprocation period, an electrostatic latent image is formed by the electrostatic recording head 3, and development for each color is performed by a corresponding one of the developing heads 5 to 8. As a result, a plurality of images of different colors are overlapped in the same image area of the recording paper P.

The recording paper P used in such an apparatus includes paper having a width ranging from about 24 to 44 inches. In order to form images of the respective colors on an image area of such large-sized recording paper with accurate color matching, some type of color misregistration preventing means must be provided. For example, U.S. Pat. No. 4,569,584 discloses a control system using control marks. This control system can correct positional errors in the recording paper feed direction and in the direction perpendicular to the feed direction, and is very effective in prevention of color misregistration.

Color misregistration due to a ramp of recording paper, however, cannot be prevented by using the above-described control system.

A ramp of the recording paper P occurs immediately after new recording paper (new replacement unit or the like) is set to replace the rolled recording paper P. The ramp amount (degree of ramp) is gradually changed every time the recording paper P is reciprocated.

FIGS. 2 and 3 respectively show states of a ramp of the recording paper P. FIG. 2 emphatically shows the posture (degree of ramp) of the rolled recording paper P which is assumed when the recording paper roll 1 is set at a predetermined position and its leading end is wound around the take-up roller 13. As shown in FIG. 2, the edge position of the recording paper P is inclined with respect to the travel direction, as indicated by X. At this time, the leading end of the recording paper P is set at a position deviated to the right in FIG. 2 from a position 0 assumed during stable travel without a ramp by a distance x. If the recording paper P is wound around the take-up roller 13 in this state, the leading end of the recording paper P is wound while spirally deviating from the normal position, as indicated by reference symbol S in FIG. 3. That is, the ramp amount of the recording paper P is gradually decreased toward a stable travel position as the take-up amount of the recording paper P around the take-up roller 13 is increased. The recording paper P finally takes a posture denoted by reference symbol Y in FIG. 3.

When the recording paper P is rewound around the recording paper roll 1, a force directed toward the stable travel position acts on the paper P. For this reason, when the leading end of the paper P is temporarily separated from the take-up roller 13 and is wound therearound again, the paper P takes a posture indicated by reference symbol Z in FIG. 2. The ramp amount of the recording paper P is changed every time the paper P is reciprocated in this manner. Therefore, if images are overlapped on the recording paper P exhibiting such a movement in the above-described manner, color misregistration inevitably occurs, and the quality of an overlapped image is greatly degraded.

Several means for preventing color misregistration due to a ramp of the recording paper P as described above have been proposed.

As a first means, U.S. Pat. No. 4,569,584 described above discloses a technique of preventing color misregistration due to a paper ramp by inclining a recording head in accordance with the ramp state of recording paper.

As a second means, U.S. Pat. No. 3,668,876 discloses a technique of correcting a ramp by inclining the shaft of a recording paper feed roller in accordance with the ramp state of recording paper.

As a third means, Published Unexamined Japanese Patent Application No. 62-215449 discloses a technique of correcting a ramp by adjusting a force acting on recording paper to urge the paper against a recording paper feed roller in accordance with the ramp state of the recording paper.

As a fourth means, Published Unexamined Japanese Patent Application No. 63-112180 discloses a technique of correcting a paper ramp by shifting a recording paper roll in a direction parallel to its axis in accordance with the ramp state of the recording paper.

Each of the first to fourth means, however, is a color misregistration preventing means using a control loop including a mechanical moving system. Therefore, these means have the following problems:

(1) Since these means require a mechanical moving system, the structure of the apparatus is inevitably complicated and increased in size.

(2) Control conditions must be changed for each type of recording paper. Therefore, the control system inevitably has a complicated arrangement.

(3) It is very difficult to find and set stabilization conditions of a control loop. For this reason, overshoot or the like tends to occur in a control operation, and stable, proper control is difficult to perform.

(4) It takes a long period of time to stabilize a control loop. In addition, during this period, a large amount of recording paper is wasted.

SUMMARY OF THE INVENTION

It is the first object of the present invention to provide a rolled recording paper setting apparatus having a simple arrangement which can stably and properly correct a ramp of recording paper occurring when new rolled recording paper is set, and can prevent color misregistration due to the ramp.

It is the second object of the present invention to provide a rolled recording paper setting apparatus having a simple arrangement which can stably and properly correct a ramp of recording paper occurring when new rolled recording paper is set, prevent color misregistration due to the ramp, and properly recognize that the ramp is corrected.

It is the third object of the present invention to provide a rolled recording paper setting apparatus having a simple arrangement which can stably and properly correct a ramp of recording paper occurring when new rolled recording paper is set, prevent color misregistration due to the ramp, and set the rolled recording paper in an excellent transfer start ready state upon correction of the ramp.

In order to achieve the above objects, according to the present invention, the following means are provided:

(1) In order to achieve the first object, there is provided a first means comprising reciprocating drive means for reciprocating a predetermined amount of the recording paper in a feed direction and a rewinding direction of the recording paper, and operation control means for causing the reciprocating drive means to perform a reciprocal operation of recording paper a plurality of times prior to image recording at least when rolled recording paper is newly set at a predetermined position.

(2) In order to achieve the second object, there is provided a second means comprising, in addition to the first means, an edge sensor, arranged to oppose a recording paper transfer path, for detecting a travel position of a recording paper edge during the reciprocal operation of the recording paper by the reciprocating drive means, judge means for judging whether an amount of change in the travel position of the recording paper edge detected by the edge sensor falls within a predetermined range, and means for outputting a setting end signal when the judge means judges that the amount of change falls within the predetermined range.

(3) In order to achieve the third object, there is provided a third means comprising, in addition to the first means, an edge sensor arranged to oppose a recording paper transfer path, for detecting a travel position of a recording paper edge during the reciprocal operation of the recording paper by the reciprocating drive means, judge means for judging whether an amount of change in the travel position of the recording paper edge detected by the edge sensor falls within a predetermined range, and means for cutting a leading portion of the recording paper in a direction perpendicular to a travel direction of the recording paper using a cutter and moving the cut end portion to a predetermined ready position when the judge means judges that the amount of change falls within the predetermined range.

By providing the first to third means (1) to (3), the following effects can be obtained:

(1) By providing the first means (1), when rolled recording paper is newly set at the predetermined position, a predetermined amount of the recording paper is successively reciprocated a plurality of times prior to image recording. In this process, the recording paper moves to a stable travel position, and hence its ramp state is automatically corrected. Therefore, color misregistration due to a ramp can be stably and properly prevented. Note that since no mechanical moving system or the like is required, the apparatus is free from an increase in size and complication in structure.

(2) By providing the second means (2), the same effects as obtained by the first means (1) can be obtained. In addition to these effects, since travel stability of recording paper can be checked, and the checking result is output as a setting end signal, it is properly recognized that a ramp is corrected.

(3) By providing the third means (3), the same effects as those obtained by the second means (2) can be obtained. In addition to these effects, since the leading portion of recording paper is cut in the direction perpendicular to the recording paper travel direction, and the cut end portion moves to the predetermined ready position upon correction of a ramp, the rolled recording paper can be set in an excellent transfer start ready state.

BRIEF DESCRIPTION OF THE DRAWINGS

FIGS. 4 to 18 are views showing an embodiment of the present invention, in which FIG. 4 is a view showing an arrangement of an apparatus of the embodiment, FIGS. 5 to 7 are views respectively showing an arrangement and a function of an optical sensor, FIGS. 8 to 10 are views each showing a state of ramp correction of recording paper, FIG. 11 is a view showing an initial set state of recording paper, FIG. 12 is a graph showing a correction effect corrected by a reciprocation movement of the recording paper, FIGS. 13 to 16 are views each showing a state of a recording paper leading portion, and FIGS. 17 and 18 are views showing a cutting process of a recording paper leading portion.

DETAILED DESCRIPTION OF THE PREFERRED EMBODIMENTS

Figure 1:
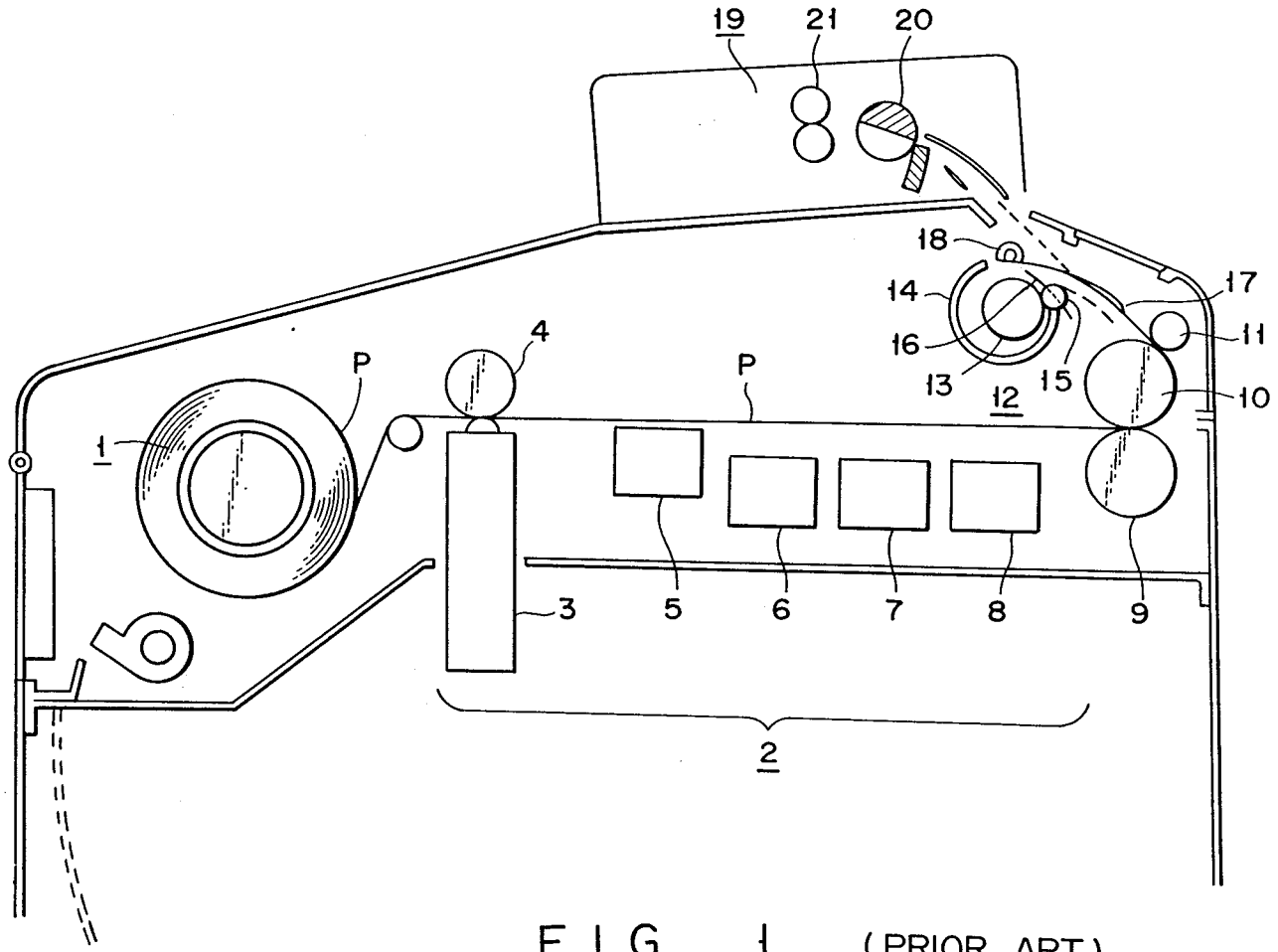
FIG. 1 (PRIOR ART)
FIG. 1 is a view showing a schematic arrangement of a prior image recording apparatus.
Figure 2:
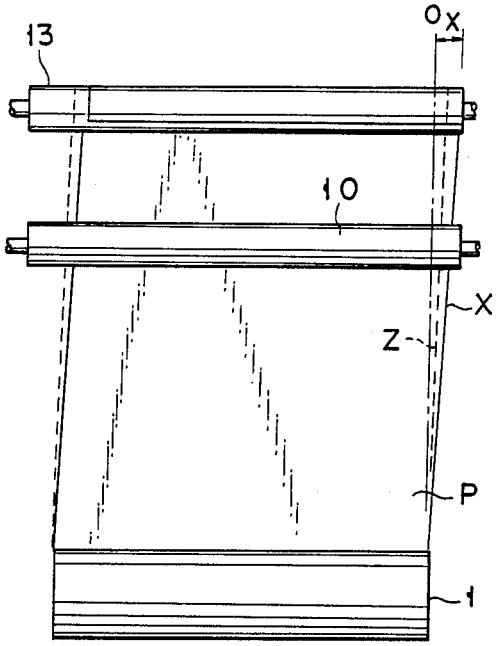
FIGS. 2 and 3 are views showing a ramp phenomenon of recording paper occurring in the apparatus in FIG. 1.
Figure 3:
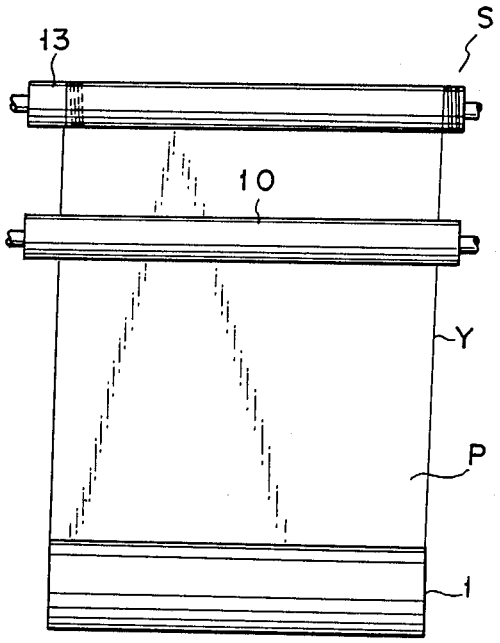
Figure 4:
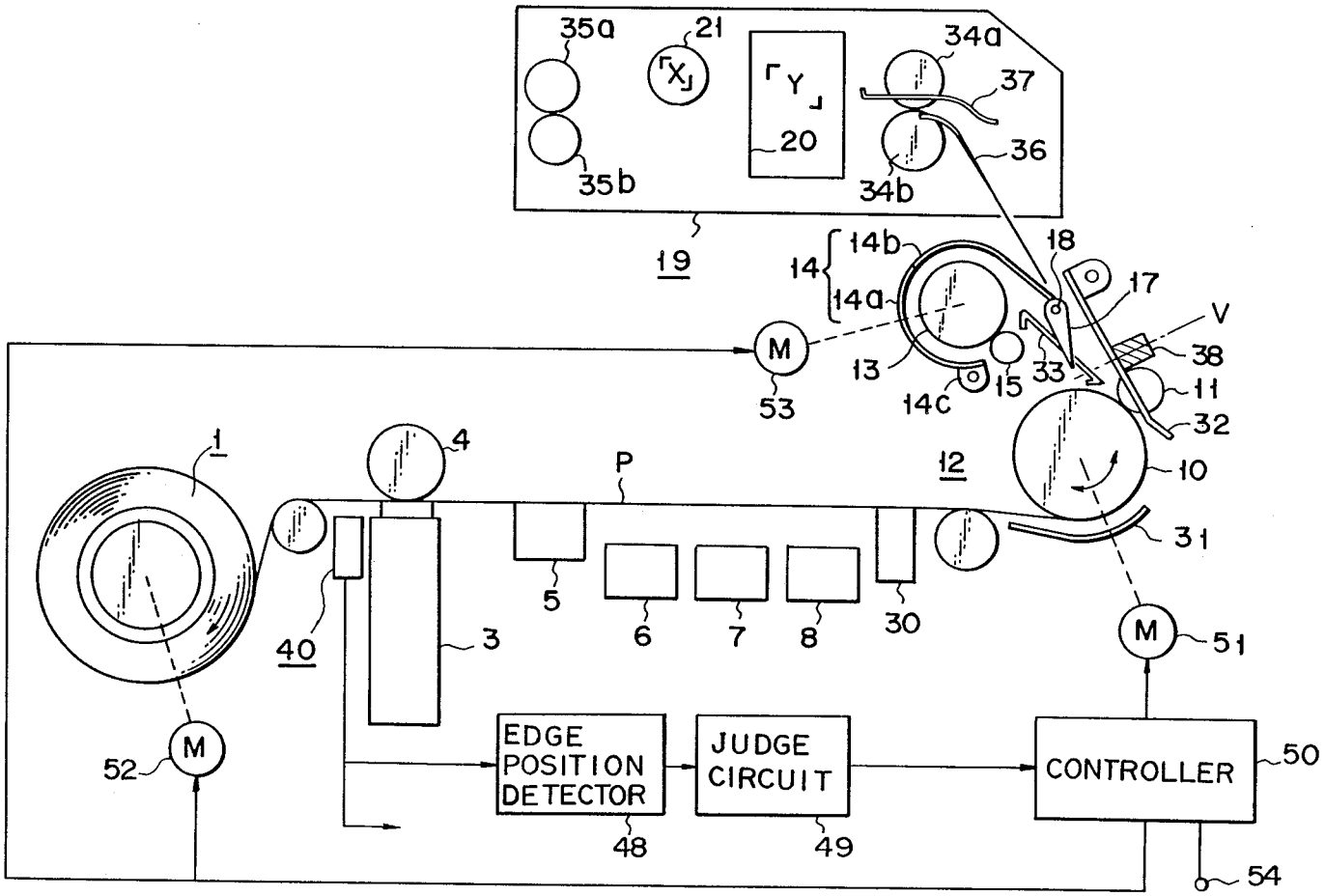

FIG. 4 shows an arrangement of a embodiment of the present invention. Note that the same reference numerals in FIG. 4 denote the parts having the same functions as in FIG. 1. Referring to FIG. 4, reference numeral 1 denotes a recording paper roll; and 2, an image recording processing station constituted by constituent elements 3 to 8. The constituent element 3 is a multistylus electrostatic recording head; the constituent element 4, a back-surface roller; and the constituent elements 5 to 8, color developing heads of different colors. Reference numeral 10 denotes a recording paper feed roller; 11, a press roller which is opposed to the roller 10 so as to be in contact therewith; 12, a unit, constituted by a recording paper take-up roller 13, a guide plate 14, a pinch roller 15, and the like, for temporarily winding recording paper; 17, a recording paper path switching guide plate having one end pivotally supported by a support shaft 18; and 19, an automatic cutter including a Y cutter 20 for cutting extracted recording paper P in a direction perpendicular to its feed direction, and an X cutter 21 for cutting the recording paper P in a direction parallel to the feed direction. The above-described components have the same functions as those of the components in FIG. 1.

Newly added portions will be described below.

Reference numeral 30 denotes a suction type drying head for drawing any residual developing solution adhering to recording paper P by using a suction force of a suction pump (not shown); and 31 to 33, guide plates. Of these guide plates, the guide plates 32 and 33, together with the recording paper path switching guide plate 17, constitute a path for guiding the recording paper P to the temporary take-up unit 12 side or the automatic cutter 19 side. A paper sensor 38 for detecting the position of the leading end of the recording paper P is attached to the guide plate 32.

The guide plate 14 as one of the constituent elements of the temporary recording paper take-up unit 12 is divided into two parts, i.e., guide plates 14*a* and 14*b*. One end of one guide plate 14*a* is pivotally supported by a support portion 14*c*. With this arrangement, the joint of the guide plates 14*a* and 14*b* is released as needed so that when paper jamming occurs, jammed paper can be easily removed.

The automatic cutter 19 includes paper feed rollers 34*a*, 34*b*, 35*a*, and 35*b*, and guide plates 36 and 37 in addition to the Y and X cutters 20 and 21.

Reference numeral 40 denotes an optical sensor. The sensor 40 is designed to optically read a timing mark formed near an edge of the recording paper P and recording paper edges.

Figure 5:
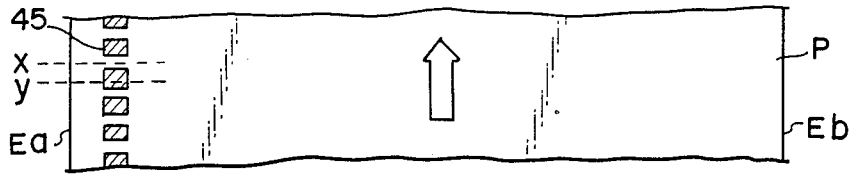
Figure 6:
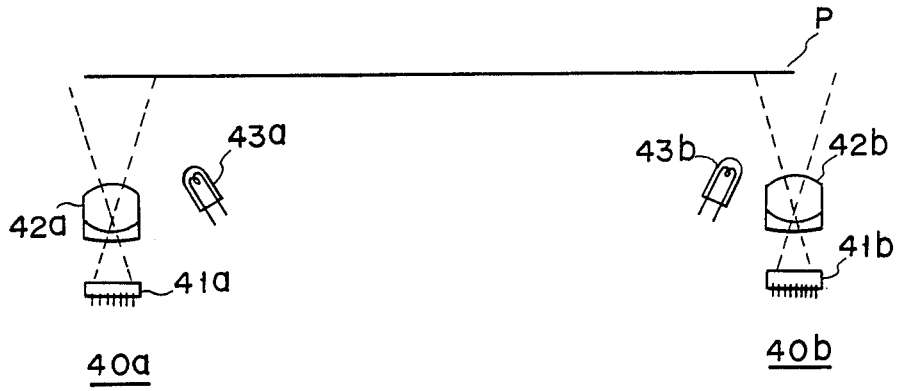
Figure 7:
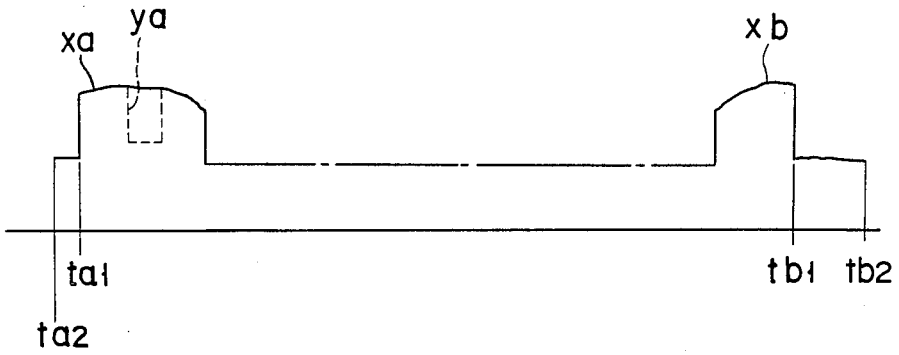

FIGS. 5 to 7 show an arrangement and a function of the optical sensor 40. As shown in FIG. 5, a timing mark 45 is written along a portion near a left edge Ea of the recording paper. The positions of the timing mark 45 and edges Ea and Eb of the recording paper P are read by the optical sensor 40.

FIG. 6 shows an arrangement of the optical sensor 40. As shown in FIG. 6, the sensor 40 comprises a pair of CCD read sensor units 40*a* and 40*b* constituted by CCD linear image sensor arrays and the like. The CCD read sensor units 40*a* and 40*b* have the same arrangement. More specifically, the sensor unit 40*a* comprises a linear array type sensor 41*a*, a projection lens 42*a*, and an illumination lamp 43*a*, whereas the sensor unit 40*b* comprises a linear array type sensor 41*b*, a projection lens 42*b*, and an illumination lamp 42*b*.

FIG. 7 shows a signal read by the CCD read sensor units 40*a* and 40*b*, i.e., the waveform of a sensor output at a position x and y in FIG. 5. As indicated by reference symbols Xa, Xb (solid line) and ya (dotted line), the sensor output changes in accordance with the positions of the recording paper edges Ea, Eb and timing mark 45. The edge position, the amount of change in the edge position, and the like of the recording paper P can be known by monitoring clock counts between points ta1 and ta2, and tb1 and tb2 between which outputs from the sensor units 40*a* and 40*b* change. Signals obtained by reading the timing mark 45 on the recording paper P and the recording paper edges Ea and Eb are used to control image formation positions in the feed direction of the recording paper P and in the direction perpendicular thereto, thereby preventing color misregistration of overlapped images in the above two directions. In addition, the edge position data of the recording paper P is used to correct the ramp of the recording paper P.

A description will be made with reference to FIG. 4 again. An output from the optical sensor 40 is input to an edge position detector 48. The detector 48 detects an edge position from the input sensor output, generates an edge position signal, and supplies it to a judge circuit 49. The judge circuit 49 compares the input edge position signal with a set value so as to judge whether the edge position falls within a predetermined range. The judgement result is supplied to a controller 50. Prior to image recording, the controller 50 controls a recording paper feed roller driving motor 51, a recording paper roll driving motor 52, and a recording paper take-up roller driving motor 53 in accordance with the input judgement result, and at the same time controls the Y cutter of the automatic cutter 19. Note that during image recording the controller 50 is operated in accordance with a command signal supplied to an input terminal 54.

As the motor 51, a motor whose direction and speed of rotation can be accurately changed in a wide range, like a pulse motor, is preferably used. As the motor 52, a motor which is always rotated clockwise is used. That is, it is preferable that when the recording paper P is to be transferred to the right in FIG. 4, the motor 52 is operated to give back tension to the recording paper P, and that when the recording paper P is to be rewound to the left in FIG. 4, the motor 52 is operated to give a rewinding force to the recording paper P.

As the above-described optical sensor 40, an array type sensor constituted by the CCD linear image sensor array and the like shown in FIG. 6 is preferably used. However, an edge position may be judged from a sensor movement amount obtained by mechanically moving a single-element sensor. In addition, the functions of the edge position detector 48 and the judge circuit 49 may be combined to form an integral unit, or the above-described functions may be obtained by using software of a microcomputer for controlling the overall operation of the apparatus.

An operation of the embodiment of the present invention including experiments will be described below.

Figure 10:
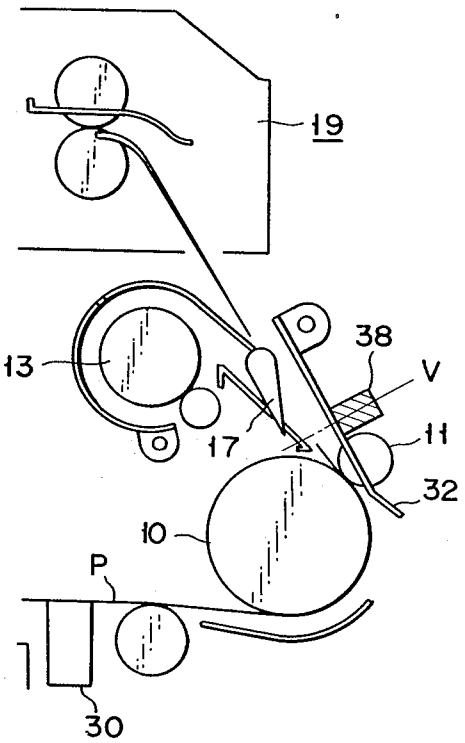
Figure 9:
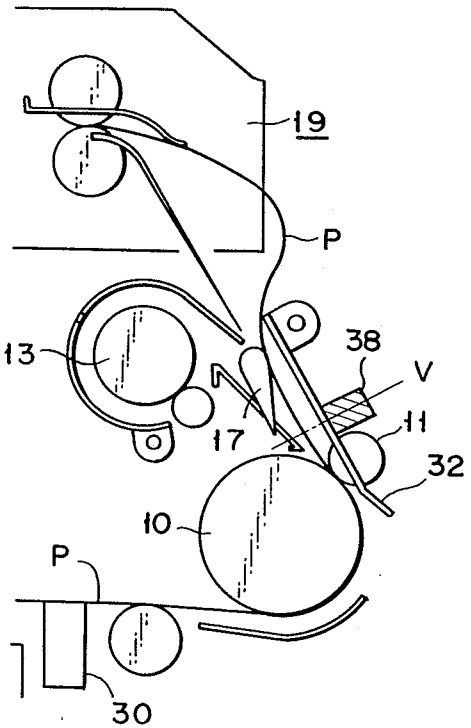
Figure 8:
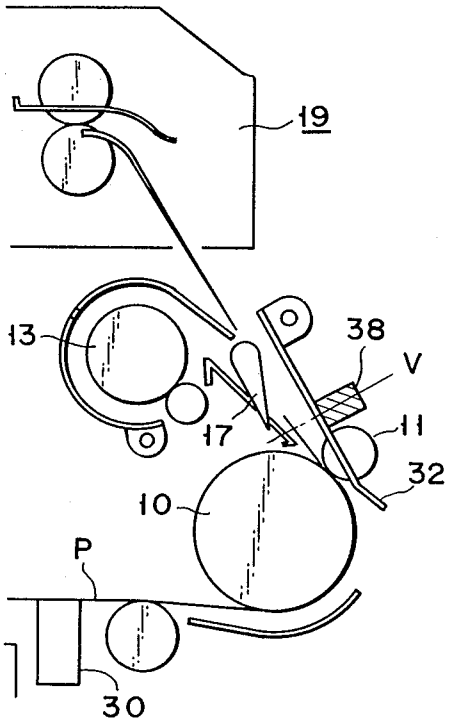

FIGS. 8 to 10 respectively show states of ramp correction of recording paper. When the rolled recording paper P is to be newly set, the leading portion of the recording paper roll 1 is extracted, and the leading portion is set to a position near the sensor 38 through the nip portion between the recording paper feed roller 10 and the press roller 11, as shown in FIG. 8. At this time, the recording paper path switching guide plate 17 takes a position to guide the recording paper P to the automatic cutter 19 side. When a power source switch, an interlock switch, and the like are turned on upon feed of the recording paper P so as to energize the apparatus, an initializing mode is automatically set. As a result, a control signal is output from the controller 50, and the motors 51 to 53 start rotating. When the recording paper feed roller 10 is rotated counterclockwise upon rotation of the motor 51, the recording paper P is fed by a predetermined amount. FIG. 9 shows this state. Subsequently, the roller 10 is rotated clockwise. As a result, the recording paper P is rewound by a predetermined amount. Note that if the motor 51 is stopped when the leading end of the recording paper P passes a detection position V of the sensor 38 as shown in FIG. 10 so as to determine a rewinding position of the recording paper P, it is advantageous in ramp correction. In addition, during this period, a predetermined rotating force is applied to the recording paper roll 1 by means of the motor 52 so as to apply necessary tension to the recording paper P and to rewind the paper P.

Such a reciprocal operation is repeated a predetermined number of times (e.g., five or 10 times) or is repeated until an amount of change in a recording paper edge to be detected by the sensor 40 (as will be described later) becomes smaller than a predetermined value, thereby completing an initial setting operation.

Figure 11:
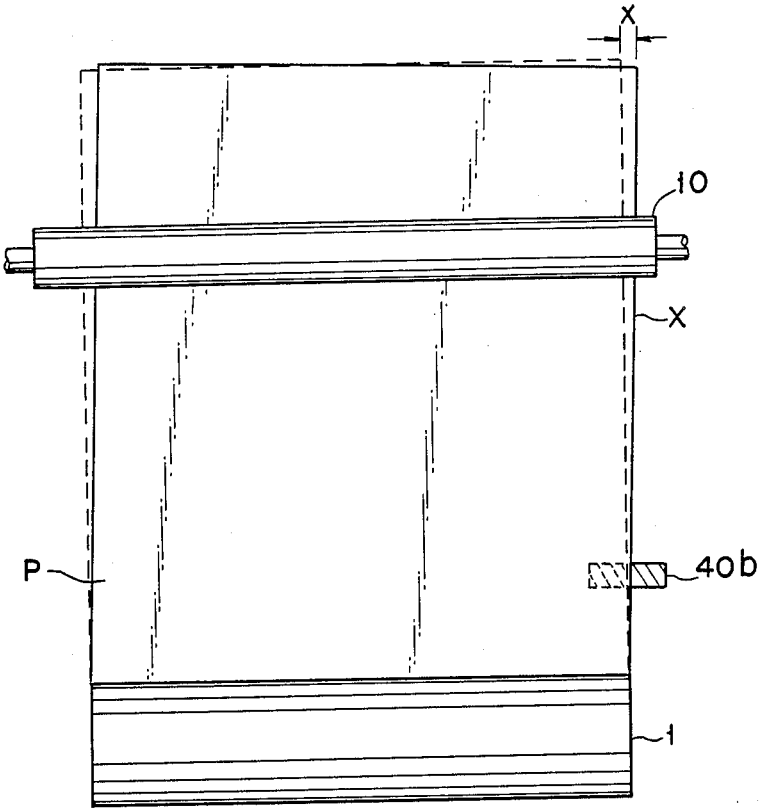

FIG. 11 shows a state wherein the initially set state (edge position) of the recording paper P is represented by reference symbol X, i.e., the edge of the leading end of the recording paper P is set at a position deviated from a normal edge position (indicated by a dotted line) during a stable travel period of the recording paper P by a distance x. The edge position at this time is read by one sensor unit **40*b***.

Figure 12:
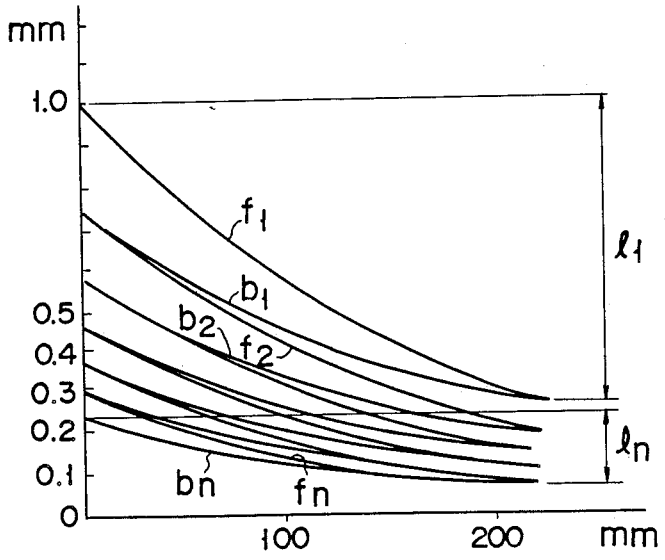

FIG. 12 is a graph showing a result obtained by observing the movement of the edge position of the recording paper P using the sensor 40 when the paper P is reciprocated n times after it is set in the state shown in FIG. 11. The recording paper P used in this case is electrostatic recording paper obtained by forming a recording surface coating on a surface of plain paper. The width of the recording paper P is 36 inches. A path length from the recording paper roll 1 to the sensor unit **40*b* is about 15 cm. A path length from the recording paper roll 1 to the recording paper feed roller 10 is about 70 cm. In addition, a reciprocation length of the recording paper P is about 22 cm. Note that the origin associated with the stable travel position of the recording paper P and the attachment position of the sensor unit 40*b* is not specifically defined. Therefore, the 0 point of the ordinate axis in FIG. 12** does not represent an absolute stable travel position but represents only an origin assumed on the sensor.

Referring to FIG. 12, reference symbol f1 denotes a locus of movement of a paper edge in the first paper feed operation. In this case, the total change amount was about 0.7 mm. Reference symbol b1 denotes a locus of movement of the paper edge in the first rewiding operation. Similarly, reference symbols f2 and b2 respectively denotes loci o movement of the paper edge in the second reciprocal operation; and fn and bn, loci of movement in the nth reciprocal operation. As shown in FIG. 12, the amount of change in the paper edge is decreased with an increase in number of reciprocal operations. The recording paper P gradually shifts to the stable travel position, i.e., corrects a ramp by itself.

Subsequently, a marking and a lattice pattern having squares of 1 $cm^2$ were written on recording paper over three meters by using an electrostatic color plotter having the same dimensions and arrangement as those of the plotter shown in FIG. 4. Note that this write operation was performed in the same manner as in a normal color image recording operation. That is, recording was performed by overlapping black, cyan, magenta, and yellow images in the same image area in the order named.

A normal color image recording operation will be briefly described below. While the recording paper P is transferred from the left to the right in FIG. 4, a recording image signal is supplied to the recording head 3 so as to form an electrostatic latent image corresponding to the first color on the recording paper P. This electrostatic latent image is developed by the developing head 5 corresponding to the first color, which is selectively raised. A portion of the recording paper P on which the developing process is completed is taken up by the take-up roller 13. Upon completion of image recording of the first color, the recording paper P is rewound to the original position. Subsequently, formation and development of an electrostatic latent image corresponding to the second color are sequentially performed by the recording head 3 and the developing head 6 for the second color, respectively, thus overlapping and recording the image of the second color in the same image area. Similarly, image recording of the third and fourth colors will be performed.

After the recording paper P is rewound prior to image recording of the last color, or upon completion of image recording of the last color, the recording paper path switching guide plate 17 is switched. As a result, the recording paper P on which the image is formed is guided to the cutter 19 side. The image-formed portion of the paper P is cut by the cutter 19 and is discharged outside the apparatus, thereby completing a series of color image forming operations.

Note that when the above-described lattice pattern and the like were written, color misregistration in the feed direction of the recording paper P and in the direction perpendicular thereto was corrected on the basis of positional error read signals of the recording paper P from the sensor units **40*a* and 40*b***. More specifically, correction of color misregistration was performed by adjusting a write position in accordance with a positional error. Therefore, if color misregistration occurs, it must be caused by a ramp of the recording paper P.

The following is a result obtained from experiments on a write operation of the lattice pattern under the above-described conditions.

Under the conditions causing an edge position change of 0.5 mm at the position of the sensor unit **40*b*** when the leading portion of the recording paper P at first was fed by a length of 22 cm, the maximum value of color misregistration discretely occurring at the respective portions of the overlapped image ranged from 0.4 to 0.6 mm.

Under the conditions causing an edge position change of 0.2 mm at the position of the sensor unit **40*b*** when the leading portion of the recording paper P at first was fed by a length of 22 cm, the maximum value of color misregistration occurring when recording of overlapped images was performed in the same manner as described above ranged from 0.1 to 0.25 mm.

It was found from the above-described experiments that color misregistration due to a ramp of the recording paper P occurs less as an amount of change in the travel position of a recording paper edge is reduced. In addition, when new recording paper roll 1 was set, an amount of change in the travel position of a recording paper edge was decreased and the recording paper P approaches the stable travel position by itself by reciprocating the recording paper P a plurality of times while its leading portion is stretched between the recording paper roll 1 and the recording paper feed roller 10.

In order to set the rolled recording paper P in the image recording apparatus, an indication line for indicating a set position may be formed. However, the paper P cannot be set with sufficient precision by set position designation using the indication line. In addition, if there is a winding error between the rolled recording paper P and a paper axle of the recording paper roll 1, a size error of the recording paper P, a dimensional change of the recording paper P upon moisture absorption and drying, or the like, the stable travel position of the recording paper P is changed. Therefore, an indication line does not indicate an accurate recording paper set position.

In this embodiment, however, when new rolled recording paper P is to be set, since a predetermined amount of the recording paper P is reciprocated a plurality of times prior to image recording so as to stabilize its travel position, the above-described problem is not posed.

Perfect setting of recording paper may not be performed by only reciprocating the paper a plurality of times. For example, if the set position of the leading end of the recording paper P in an initial set state is greatly deviated from a normal position, the set position may not be corrected to the stable travel position by only performing a reciprocal operation a predetermined number of times. On the other hand, if the initial set position is near the stable position, a reciprocal operation is repeated an unnecessarily large number of times. As a result, a certain period of time is wasted for setting stabilization. In order to eliminate such an inconvenience, a sensor for monitoring the position of a recording paper edge in the feed direction of the recording paper P and in the direction perpendicular thereto may be arranged to oppose the recording paper path. With this arrangement, when the movement amount of the recording paper edge becomes smaller than a predetermined value, a setting end signal is generated to stop a reciprocal operation of the recording paper P. Alternatively, if the movement amount of the recording paper P does not become smaller than the predetermined value even by performing a reciprocal operation a predetermined number of times, a set error signal is preferably output.

This embodiment, therefore, comprises the edge position detector 48 for detecting an edge position upon reception of a sensor signal from the edge sensor 40, and the judge circuit 49 for comparing the detected edge position with a set value so as to judge whether the edge position falls within a predetermined range. With this arrangement, the above-described requirement can be satisfied.

In the apparatus comprising the automatic cutter 19 on the downstream side of the recording paper feed roller 10, the leading end of the recording paper P is cut by the cutter 19 upon completion of ramp correction of the recording paper P, so that a further excellent cutting state can be obtained.

Figure 13:
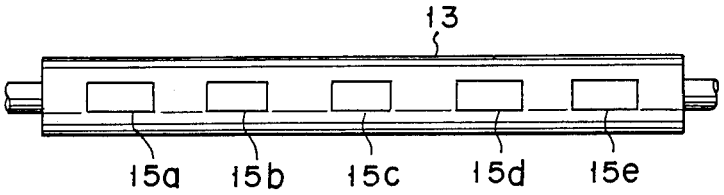
Figure 14:
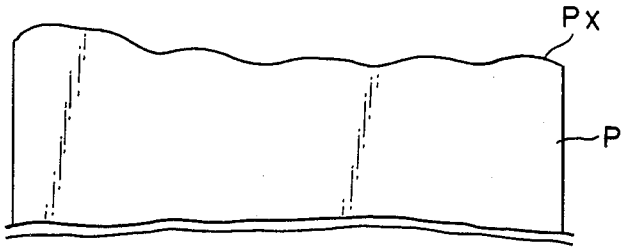
Figure 15:
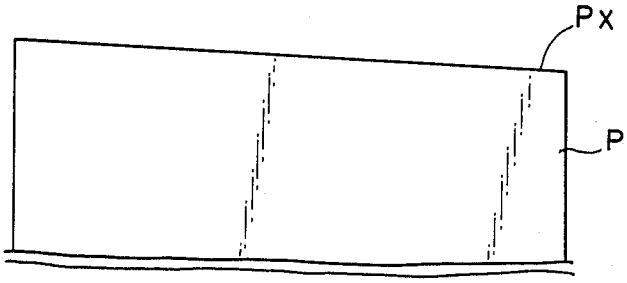

FIGS. 13 to 16 are views for explaining the effects obtained with the above-described arrangement. FIG. 13 shows a relationship in arrangement between the temporary take-up unit 12, the take-up roller 13, and the pinch roller 15. FIGS. 14 and 15 respectively show typical shapes of the leading ends of newly set recording paper P. If the recording paper P is fed to the unit 12 to perform image recording after the paper P is set and a predetermined amount thereof is reciprocated to correct its position, the leading end of the paper P moves around the take-up roller 13 by slightly less than one rotation and reaches the nip portion between the roller 13 and the pinch roller 15. At this time, the take-up roller 13 is rotated at a peripheral speed several times the transfer speed of the recording paper P. For this reason, when the leading end of the recording paper P is clamped by the nip portion between the pinch roller 15 and the roller 13, the paper P is tightly wound around the take-up roller 13 within a short period of time.

In this case, if a leading end px of the recording paper P is uneven with respect to the pinch roller 15 as shown in FIG. 14, or is inclined with respect to the roller 15 as shown in FIG. 15, a recording paper portion which reaches the nip portion earlier is tightly wound around the roller 13 than the remaining portion. As a result, the remaining portion which reaches the nip portion later cannot be tightly wound around the roller 13 in a satisfactorily manner and becomes loose. Such uneven winding tension acts on various portions of the recording paper P through the recording paper feed roller 10 and distorts the paper P. In addition, it acts on the recording paper P to shift it from the stable travel position, and hence causes color misregistration.

Figure 16:
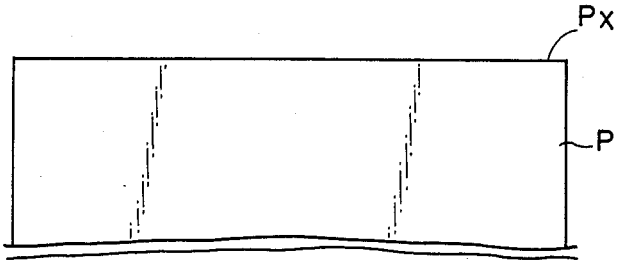

In order to eliminate such an inconvenience, in this embodiment after the ramp of the recording paper P is corrected, the leading end of the paper P is cut, as described above. FIG. 16 shows a state of the leading portion of the recording paper P after its leading end is cut in this manner. If the recording paper P is fed to nip portions **15*a* to 15*e* of the pinch roller 15 while the leading portion of the paper P is cut in the direction perpendicular to the feed direction, the leading end of the paper P is simultaneously clamped by the nip portions. As a result, the entire leading portion is tightly wound around the roller 13** in an even manner, thus preventing an uneven force causing a ramp of the recording paper P. Therefore, color misregistration can be prevented.

Figure 17:
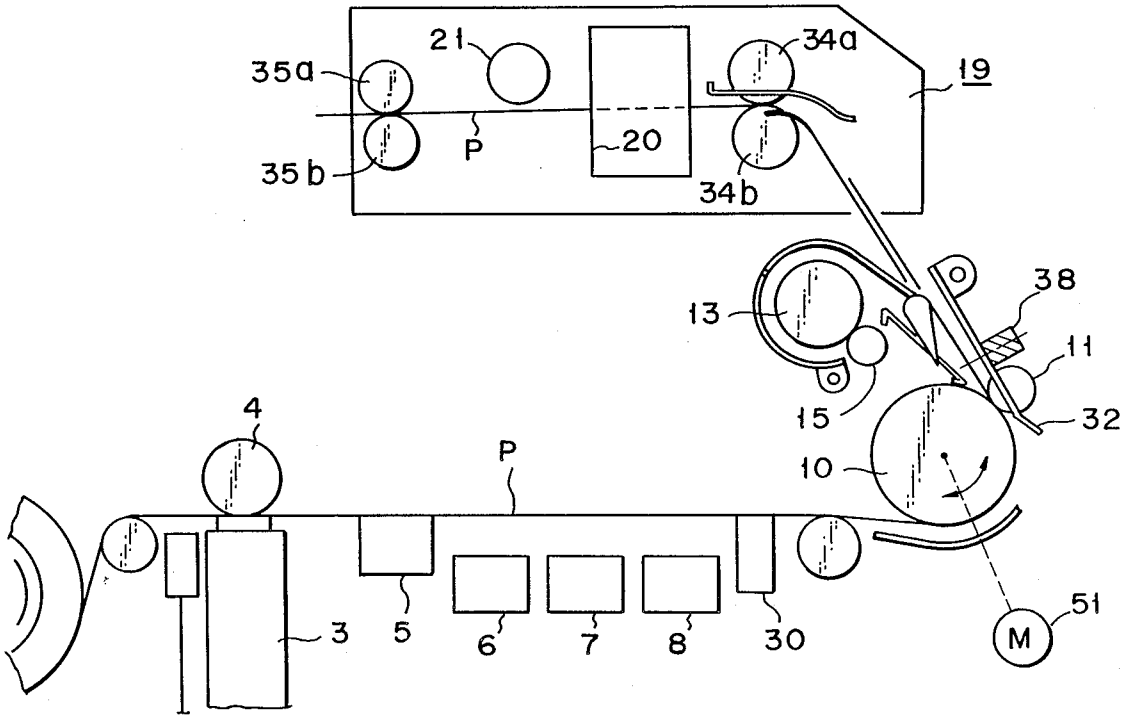
Figure 18:
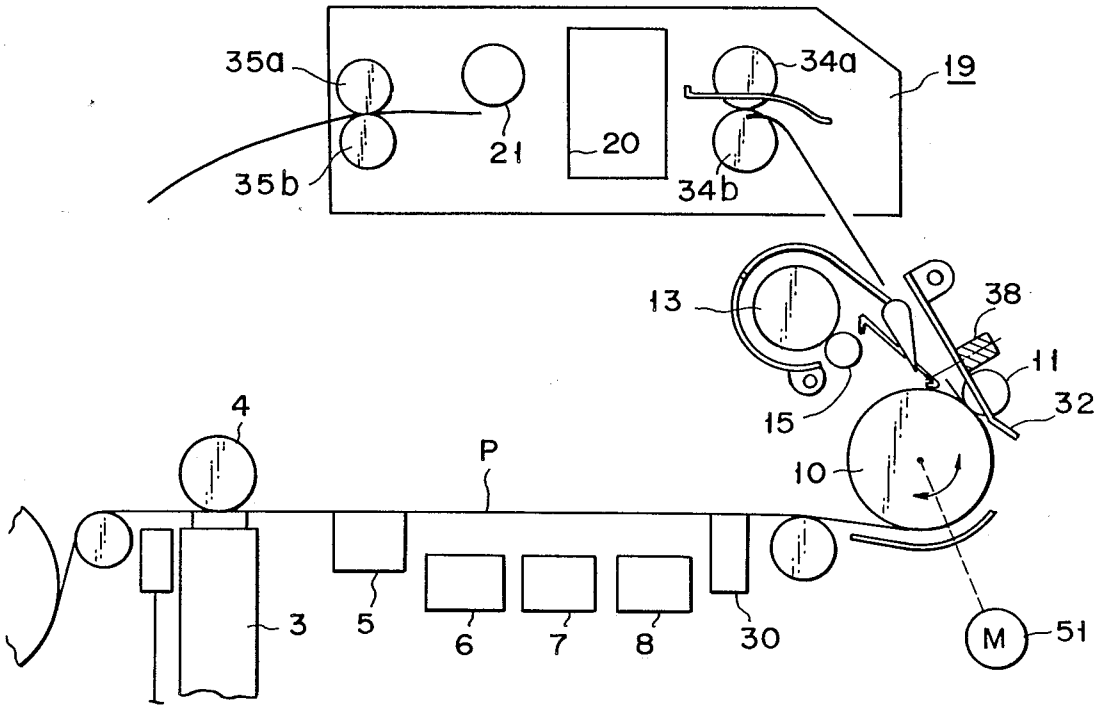

FIGS. 17 and 18 show a process of cutting the leading end of the recording paper P. As shown in FIG. 17, the recording paper P whose position has been corrected is guided into the cutter 19 and is fed to at least a position at which the leading end passes through the operation position of the Y cutter 20 and the length of the leading end to be cut is large enough to be discharged from the Y cutter 20. In this state, the Y cutter 20 is actuated to cut the leading end of the recording paper P. The separated leading portion is discharged from the Y cutter 20. At the same time, the leading portion of the recording paper P which is continuous with the recording paper roll 1 is rewound to reach the detection position V of the sensor 38, and stops, as shown in FIG. 18, thereby completing the recording paper setting operation.

The present invention is not limited to the above-described embodiment. Various changes and modifications can be made within the spirit and scope of the invention.

What is claimed is:

1. A rolled recording paper setting apparatus for use with a multi-color image recording apparatus which includes a recording paper roll from which recording paper is extracted, an image recording processing station, a recording paper feed roller, and a recording paper take-up roller, for reciprocating, between feed and rewind directions, an extracted portion of rolled recording paper stretched between said recording paper roll and said recording paper take-up roller a plurality of times, and obtaining a multicolor image by overlapping and forming images of different colors in the same image area of the recording paper by operating said image recording processing station during reciprocation periods, said rolled recording paper setting apparatus comprising:

reciprocating drive means for reciprocating a predetermined length of the recording paper in said feed and rewind directions; and operation control means coupled to said reciprocating drive means for causing said reciprocating drive means to reciprocate the recording paper a plurality of times prior to image recording at least during an initialization mode at the time when rolled recording paper is newly set at a predetermined position upon replacement thereof, to thereby prevent color misregistration when said image recording processing station is thereafter operated to produce a multicolor image.

2. A rolled recording paper setting apparatus for use with a multi-color image recording apparatus which includes a recording paper roll from which recording paper is extracted, an image recording processing station, a recording paper feed roller, and a recording paper take-up roller, for reciprocating, between feed and rewind directions, an extracted portion of rolled recording paper stretched between said recording paper roll and said recording paper take-up roller a plurality of times, and obtaining a multicolor image by overlapping and forming images of different colors in the same image area of the recording paper by operating said image recording processing station during reciprocation periods, said rolled recording paper setting apparatus comprising:

reciprocating drive means for reciprocating a predetermined length of the recording paper in said feed and rewind directions; and operation control means for causing said reciprocating drive means to reciprocate the recording paper a plurality of times prior to image recording at least when rolled recording paper is newly set at a predetermined position;

edge sensor means arranged to oppose a recording paper transfer path for detecting a travel position of a recording paper edge during a reciprocal operation of the recording paper by said reciprocating drive means;

judge means for judging whether an amount of change in the travel position of the recording paper edge detected by said edge sensor falls within a predetermined range; and outputting means for outputting a setting end signal when said judge means judges that said amount of change in the travel position of the recording paper falls within the predetermined range.

3. A rolled recording paper setting apparatus for use with a multi-color image recording apparatus which includes a recording paper roll from which recording paper is extracted, an image recording processing station, a recording paper feed roller, and a recording paper take-up roller, for reciprocating, between feed and rewind directions, an extracted portion of rolled recording paper stretched between said recording paper roll and said recording paper take-up roller a plurality of times, and obtaining a multicolor image by overlapping and forming images of different colors in the same image area of the recording paper by operating said image recording processing station during reciprocation periods, said rolled recording paper setting apparatus comprising:

reciprocating drive means for reciprocating a predetermined length of the recording paper in said feed and rewind directions; and operation control means for causing said reciprocating drive means to reciprocate the recording paper a plurality of times prior to image recording at least when rolled recording paper is newly set at a predetermined position;

edge sensor means arranged to oppose a recording paper transfer path for detecting a travel position of a recording paper edge during a reciprocal operation of the recording paper by said reciprocating drive means;

judge means for judging whether an amount of change in the travel position of the recording paper edge detected by said edge sensor falls within a predetermined range;

outputting means for outputting a setting end signal when said judge means judges that said amount of change in the travel position of the recording paper falls within the predetermined range; and means for cutting a leading portion of the recording paper in a direction perpendicular to the feed direction of the recording paper by means of a cutter, and for moving a cut leading portion to a predetermined ready position thereafter when said judge means judges that said amount of change in the travel position of the recording paper falls within the predetermined range.

* * * * *